US012612200B2

(12) United States Patent
Oumi et al.

(10) Patent No.: US 12,612,200 B2
(45) Date of Patent: Apr. 28, 2026

(54) DRUG SUPPLY APPARATUS

(71) Applicant: PHC Holdings Corporation, Tokyo (JP)

(72) Inventors: Syou Oumi, Ehime (JP); Shiyouji Shibata, Ehime (JP); Toshiaki Ueta, Tokushima (JP)

(73) Assignee: PHC HOLDINGS CORPORATION, Tokyo (JP)

( * ) Notice: Subject to any disclaimer, the term of this patent is extended or adjusted under 35 U.S.C. 154(b) by 0 days.

(21) Appl. No.: 18/615,842

(22) Filed: Mar. 25, 2024

(65) Prior Publication Data

US 2024/0228087 A1 Jul. 11, 2024

Related U.S. Application Data

(63) Continuation of application No. PCT/JP2022/035218, filed on Sep. 21, 2022.

(30) Foreign Application Priority Data

Sep. 29, 2021 (JP) ..... 2021-159486

(51) Int. Cl.
*B65B 9/087* (2012.01)
*B65B 1/30* (2006.01)
*B65B 41/16* (2006.01)

(52) U.S. Cl.
CPC ..... *B65B 9/087* (2013.01); *B65B 1/30* (2013.01); *B65B 41/16* (2013.01)

(58) Field of Classification Search
CPC B65B 9/087; B65B 1/30; B65B 41/16; B65B 9/06; B65B 41/12; G07F 11/005;
(Continued)

(56) References Cited

U.S. PATENT DOCUMENTS 3,473,994 A * 10/1969 Levenson, Jr. .... B65H 19/1836 156/504
3,753,833 A * 8/1973 Bassett ..... B65H 19/1852 156/507
(Continued)

FOREIGN PATENT DOCUMENTS

EP 3199138 A1 8/2017
JP S59-016805 U 2/1984
(Continued)

OTHER PUBLICATIONS

Extended European Search Report received in corresponding EP Patent Application No. 22875996.5, dated Dec. 19, 2024.
(Continued)

*Primary Examiner* — Shelley M Self
*Assistant Examiner* — Katie L Gerth
(74) *Attorney, Agent, or Firm* — Rimon P.C.

(57) ABSTRACT

A drug supply apparatus of the present disclosure includes a drug supply unit configured to supply a drug to a drug delivery position; a downstream conveying unit configured to convey a strip-shaped first drug packaging paper, folded in half in advance along its longitudinal direction, in such a way that the first drug packaging paper receives the drug at the drug delivery position; an upstream conveying unit configured to convey a strip-shaped second drug packaging paper folded in half in advance along its longitudinal direction toward the first drug packaging paper; and a connecting part configured to connect a downstream end part of the second drug packaging paper to the first drug packaging paper.

10 Claims, 9 Drawing Sheets

(58) Field of Classification Search
CPC ..... G07F 11/04; G07F 11/06; G07F 9/023; G07F 11/10; G07F 17/0092; B65H 2557/512; B65H 19/1852; B65H 19/1873; B65H 2301/46312; B65H 2701/1944; B65H 2301/46015; B65H 2301/46017
USPC ..... 53/455
See application file for complete search history.

(56) References Cited

U.S. PATENT DOCUMENTS 3,880,698 A * 4/1975 Kawazura ..... B65H 19/1831 156/504
4,157,934 A * 6/1979 Ryan ..... B65H 19/1873 242/551
4,190,475 A * 2/1980 Marschke ..... B65H 19/1873 226/97.1
4,219,378 A * 8/1980 Marschke ..... B65H 19/1873 156/159
4,481,053 A * 11/1984 Tokuno ..... B65H 19/1852 156/159
4,722,489 A * 2/1988 Wommer ..... B65H 19/1852 242/556.1
4,772,350 A * 9/1988 Gamberini ..... B65H 19/20 156/159
5,033,688 A * 7/1991 Georgitsis ..... B65H 19/1836 242/554.2
5,064,488 A * 11/1991 Dickey ..... B65H 21/02 156/304.3
5,308,007 A * 5/1994 Stroszynski ..... B65H 19/1836 242/555.4
5,411,223 A * 5/1995 Gatteschi ..... B65H 19/1852 242/554.2
5,514,237 A * 5/1996 Emenaker ..... B29C 66/8161 156/159
7,326,308 B2 * 2/2008 Mace ..... B65H 19/1852 156/304.6
7,708,043 B2 * 5/2010 Pasqualoni ..... B65H 19/1873 156/159
2002/0074078 A1 * 6/2002 Van Heck ..... B29C 66/853 156/254
2003/0188517 A1 * 10/2003 Paradissis ..... B29C 66/83517 53/201
2007/0029037 A1 * 2/2007 Deininger ..... B65B 9/13 156/293
2008/0308213 A1 * 12/2008 Hagman ..... B65H 39/16 83/109
2017/0301087 A1 * 10/2017 Yuyama ..... A61J 1/03
2018/0186590 A1 * 7/2018 Pedercini ..... B65H 19/1842
2022/0081245 A1 * 3/2022 Thienst ..... B65H 19/20
2024/0228086 A1 * 7/2024 Oumi ..... A61J 3/00

FOREIGN PATENT DOCUMENTS

JP 2010-023999 A 2/2010
JP 2014-058149 A 4/2014
JP 5577526 B2 8/2014
JP 5983712 B2 9/2016
JP 5994644 B2 * 9/2016

OTHER PUBLICATIONS

International Search Report dated Nov. 15, 2022 issued in International Patent Application No. PCT/JP2022/035218, with English translation.
Extended European Search Report dated Apr. 14, 2025 issued in the corresponding European Patent Application No. 22876073.2.
Non-Final Office Action dated Mar. 27, 2025 issued in related U.S. Appl. No. 18/615,822.

* cited by examiner

DRUG SUPPLY APPARATUS

CROSS-REFERENCE OF RELATED APPLICATIONS

This is a Continuation of International Application No. PCT/JP2022/035218, filed on Sep. 21, 2022, which claims priority to Japanese Patent Application No. 2021-159486, filed on Sep. 29, 2021, the entire disclosures each of which are hereby incorporated by reference.

TECHNICAL FIELD

The present disclosure relates to a drug supply apparatus.

BACKGROUND ART

Patent Literature (hereinafter, referred to as PTL) 1 discloses a packaging paper connecting apparatus used for replacing old packaging paper with new packaging paper—the packaging paper has been folded in half in advance along the longitudinal direction thereof and is used to package a drug. The packaging paper connecting apparatus connects the terminal end of the old wrapping paper to the starting end of the new packaging paper. An operator manually overlaps the terminal end of the old packaging paper and the starting end of the new packaging paper, and places the overlapped portions at a predetermined position. As the operator connects the overlapped portions to each other, the terminal end of the old packaging paper and the starting end of the new packaging paper are connected.

CITATION LIST

Patent Literature

PTL 1
Japanese Patent No. 5577526

SUMMARY OF INVENTION

Technical Problem

In the packaging paper connecting apparatus of PTL 1, an operator manually replaces packaging paper. In addition, during the replacing of the packaging paper, the packaging of a drug is stopped and the drug is not supplied. Therefore, when the time required to replace the packaging paper increases because, for example, the operator is not accustomed to replace the packaging paper, the time during which a drug is not supplied increases and, as a result, the patient's waiting time increases.

An object of the present disclosure is to shorten the time required to replace packaging paper in a drug supply apparatus.

Solution to Problem

A drug supply apparatus of the present disclosure includes the following: a drug supply unit configured to supply a drug to a drug delivery position; a downstream conveying unit configured to convey a first drug packaging paper in such a way that the first drug packaging paper receives the drug at the drug delivery position, in which the first drug packaging paper is strip shaped and folded in half in advance along a longitudinal direction of the first drug packaging paper; an upstream conveying unit configured to convey a second drug packaging paper toward the first drug packaging paper, in which the second drug packaging paper is strip shaped and folded in half in advance along a longitudinal direction of the second drug packaging paper; and a connecting part configured to connect a downstream end part of the second drug packaging paper to the first drug packaging paper.

Advantageous Effects of Invention

A drug supply apparatus of the present disclosure is capable of shortening the time required to replace packaging paper.

DESCRIPTION OF EMBODIMENTS

Hereinafter, at least one embodiment of the drug supply apparatus of the present disclosure will be described with reference to the drawings. In the following description, the side where operation part 11 is disposed is referred to as the front of drug supply apparatus 1, and the opposite side is referred to as the back of drug supply apparatus 1 as indicated by the arrows in FIG. 1. In addition, the left and right sides of drug supply apparatus 1 when viewed from the front thereof are referred to as the left and right of drug supply apparatus 1, respectively. The side away from the surface on which drug supply apparatus 1 is installed is referred to as the top of drug supply apparatus 1 (upward or above the apparatus), and the opposite side is referred to as the bottom of drug supply apparatus 1 (downward or below the apparatus).

Figure 1:
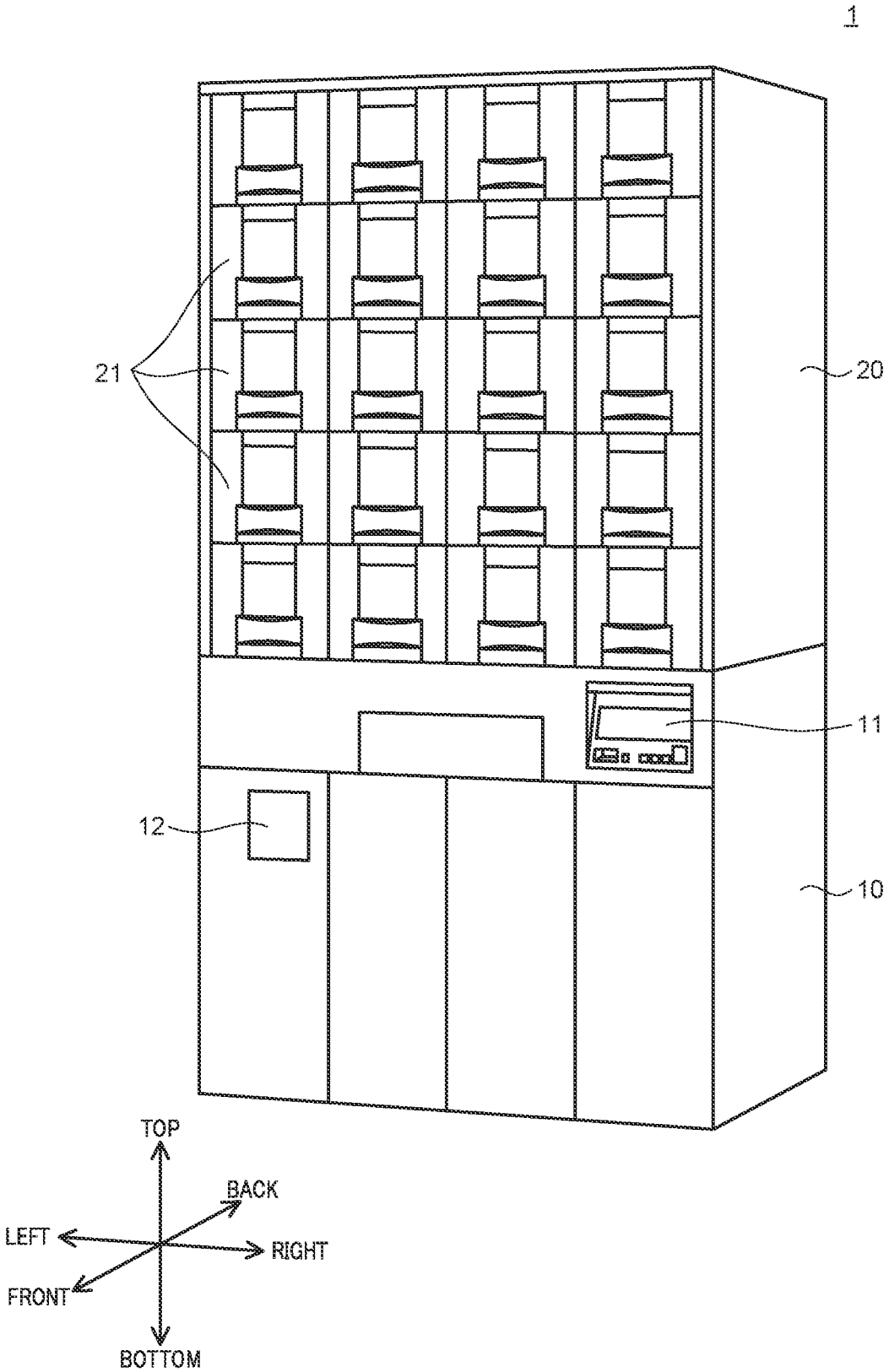
FIG. 1 is a perspective view of a drug supply apparatus according to an embodiment of the present disclosure.

FIG. 1 is a perspective view of exemplary drug supply apparatus 1. Drug supply apparatus 1 includes first floor part 10 and second floor part 20.

First floor part 10 includes operation part 11 and take-out part 12. In addition, first floor part 10 includes an input part (not illustrated).

Operation part 11 is a device to be operated by an operator, and includes, for example, a display, operation buttons, and the like. Various information is input to drug supply apparatus 1 as the operator operates operation part 11.

A drug (herein, a drug may be more than one drug) packaged in drug supply apparatus 1 is taken out from take-out part 12. Take-out part 12 includes an opening, and the operator takes out the drug from the opening.

The input part is an input device receiving various information input from an external device. The input part is connected to, for example, a personal computer, and receives input from the personal computer, for example, information on a prescription issued at a medical institution.

Figure 2:
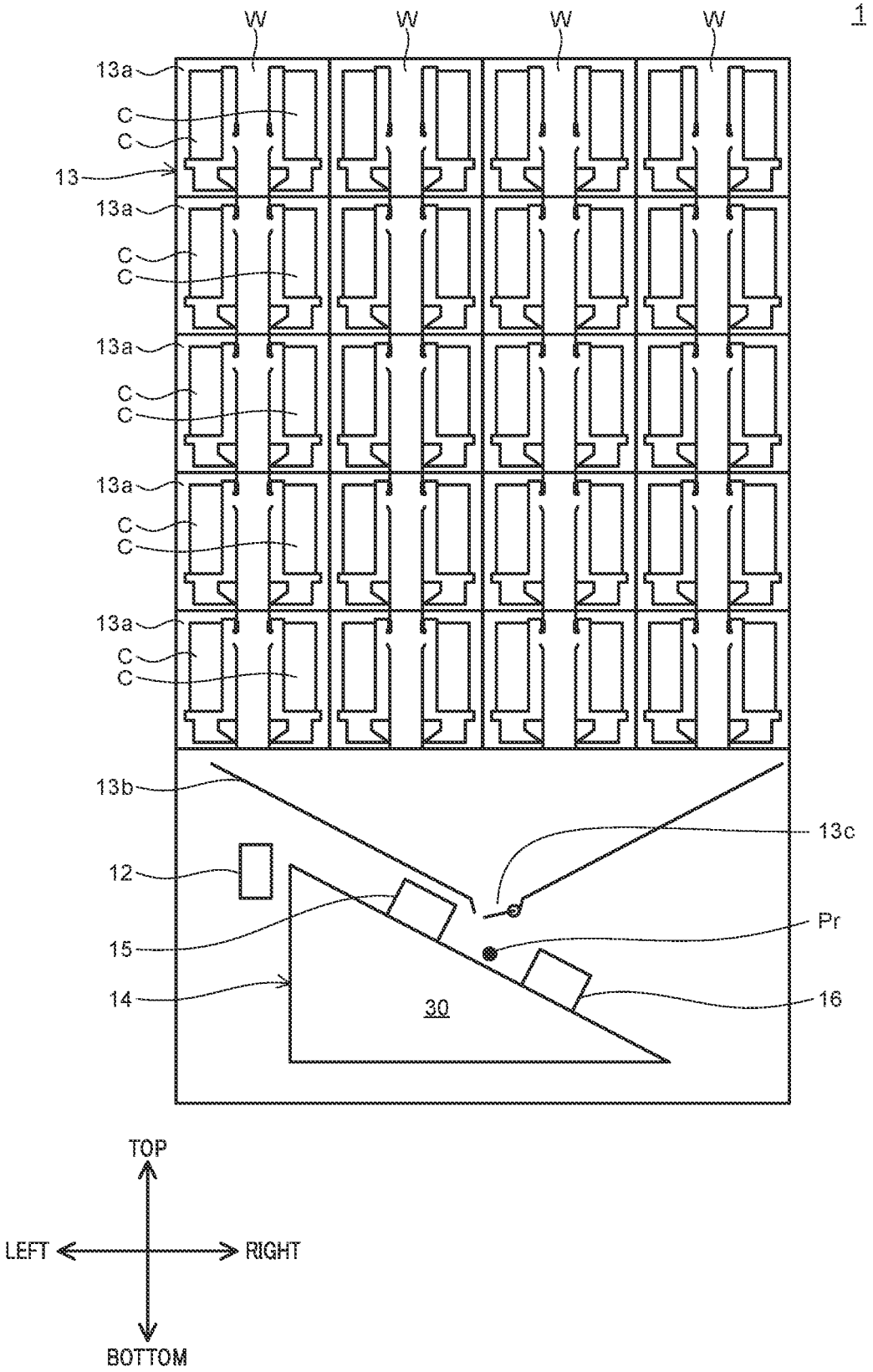
FIG. 2 is a longitudinal cross-sectional view of the drug supply apparatus.

As illustrated in FIG. 2, drug supply apparatus 1 includes drug supply unit 13, packaging unit 14, and control part (not illustrated) which performs overall control of drug supply apparatus 1. Drug supply unit 13 is configured to supply a drug to drug delivery position Pr. Drug supply unit 13 includes a plurality of shelves 13*a* and hopper 13*b*.

The plurality of shelves 13*a* are each configured to store the plurality of cassettes C in the second floor part. Drug supply apparatus 1 includes 20 shelves 13*a*. The plurality of shelves 13*a* are arranged in five stages in the up-down direction and in four rows in the left-right direction. The number and arrangement of shelves 13*a* provided in second floor part 20 are not limited to those of the present embodiment, and the number of stages in the up-down direction and/or the number of rows in the left-right direction may be more or less than those described above.

A plurality of cassettes C are stored in each shelf 13*a* so as to be arranged on shelf 13*a* along the front and rear direction on both sides of shelf 13*a* in the left-right direction. Each cassette C stores a plurality of drugs. Each cassette C is configured to discharge one tablet of a drug at a time.

The drug discharged from cassette C falls through passage Wand is led to first floor part 10. Passage W is provided so as to penetrate each shelf 13*a* in the up-down direction.

Hopper 13*b* is configured to receive the drug led to first floor part 10, and lead the received drug through outlet 13*c* to drug delivery position Pr in packaging unit 14. Outlet 13*c* is provided approximately at the center of hopper 13*b*.

Packaging unit 14 is configured to package the drug led out from hopper 13*b*. Packaging unit 14 includes conveying part 30, printer 15, and sealing device 16.

Conveying part 30 is configured to convey strip-shaped packaging paper for packaging a drug. Details of conveying part 30 will be described below.

Printer 15 is a printing machine for printing, for example, the patient's name, the name of the drug to be supplied in packaging paper conveyed by conveying part 30, the date and time of administration, and the like on the surface of the packaging paper.

Sealing device 16 is for sealing the packaging paper in which a drug is wrapped.

The packaging paper in which the drug is enclosed is cut, for example, with predetermined timing and is conveyed toward take-out part 12 with the conveyance direction thereof changed by conveying part 30.

Figure 3:
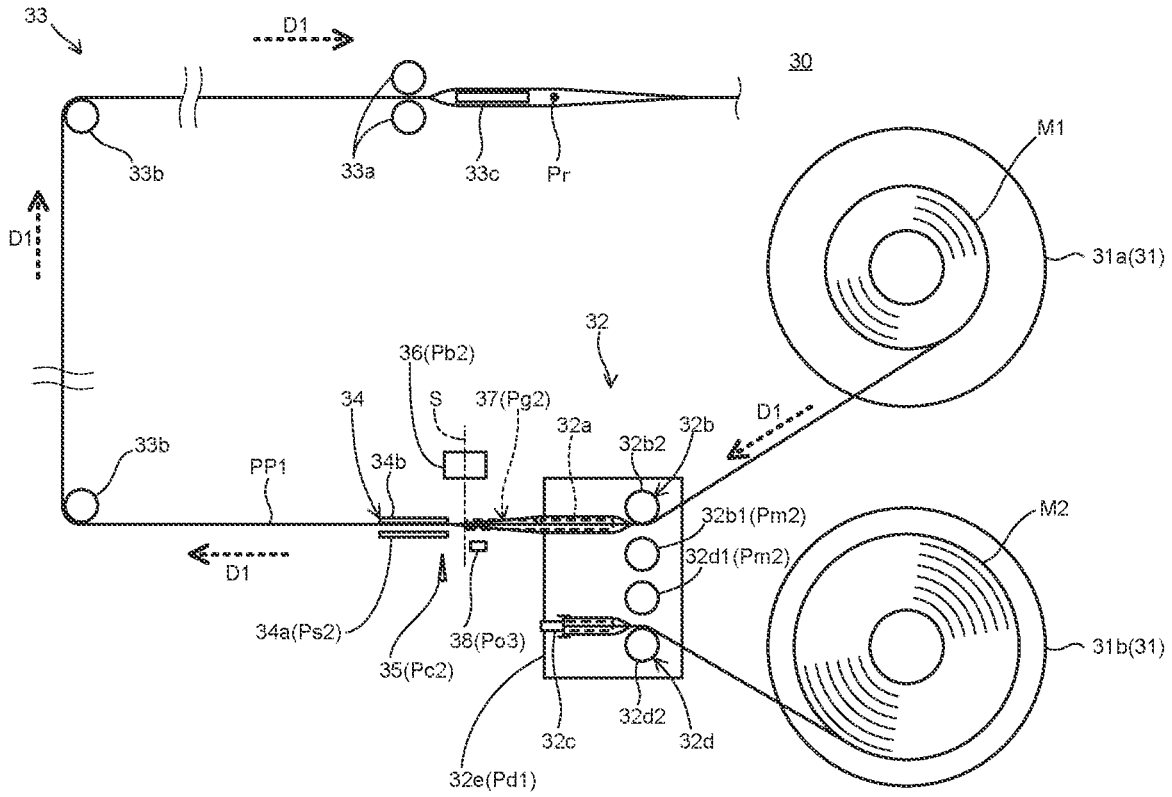
FIG. 3 schematically illustrates a portion of a conveying part.

In the following, conveying part 30 will be described. As illustrated in FIG. 3, conveying part 30 includes packaging paper holding part 31, upstream conveying unit 32, downstream conveying unit 33, holding member 34, cutting part 35, base part 36, guide member 37, and connecting part 38. The broken line arrow in FIG. 3 indicates conveyance direction D1 of first drug packaging paper PP1.

Packaging paper holding part 31 includes first packaging paper holding part 31*a* and second packaging paper holding part 31*b*. First packaging paper holding part 31*a* rotatably holds roll M1, which is a package of strip-shaped first drug packaging paper PP1 having been folded in half in advance along the longitudinal direction of first drug packaging paper PP1. Second packaging paper holding part 31*b* rotatably holds roll M2, which is a package of strip-shaped second drug packaging paper PP2 having been folded in half in advance along the longitudinal direction of second drug packaging paper PP2. The packages of first drug packaging paper PP1 and second drug packaging paper PP2 may be first drug packaging paper PP1 in folds and second drug packaging paper PP2 in folds.

First packaging paper holding part 31*a* and second packaging paper holding part 31*b* can be exchanged for each other. That is, first packaging paper holding part 31*a* can hold roll M2, and second packaging paper holding part 31*b* can hold roll M1. In this case, a pair of rollers 32*b* described below nip (i.e., hold the drug packaging paper between the rollers) and convey second drug packaging paper PP2, and another pair of rollers 32*d* guide first drug packaging paper PP1 without nipping the drug packaging paper.

Upstream conveying unit 32 includes upstream guide member 32*a*, a pair of rollers 32*b*, another upstream guide member 32*c*, the other pair of rollers 32*d*, and moving member 32*e*.

Figure 4:
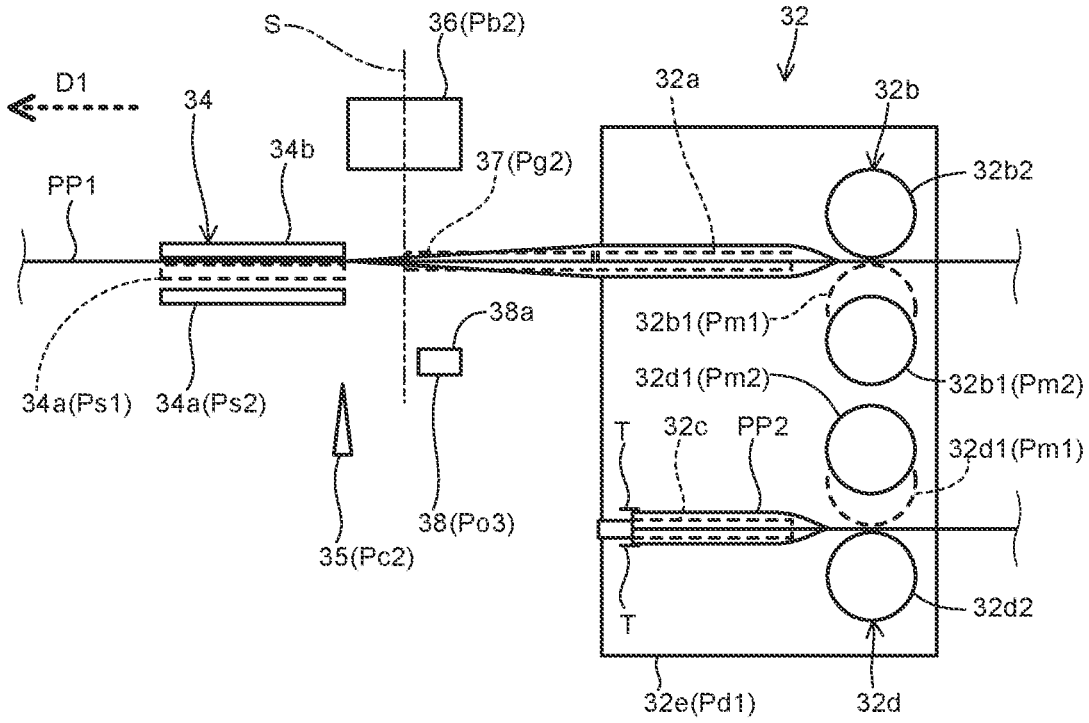
FIG. 4 is a partially enlarged view of FIG. 3.
Figure 5:
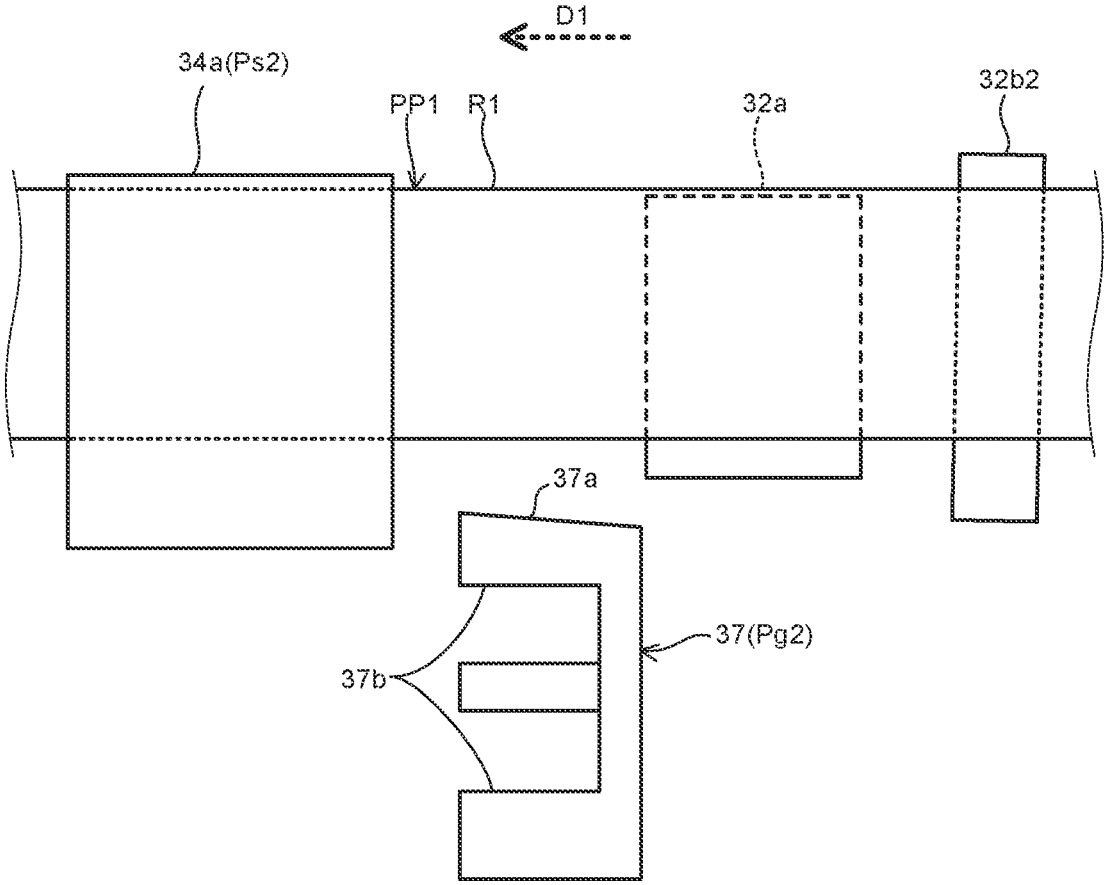
FIG. 5 illustrates the side and a periphery of first drug packaging paper in FIG. 4.

Upstream guide member 32*a* is configured to guide along conveyance direction D1 first drug packaging paper PP1 fed out from first packaging paper holding part 31*a*. Upstream guide member 32*a* is a plate-shaped member sandwiched by first drug packaging paper PP1. As illustrated in FIGS. 4 and 5, which are an enlarged view and a side view of upstream conveying unit 32 and holding member 34 and the peripheries thereof, upstream guide member 32*a* is disposed in such a way that the side surface thereof coinciding with ridge line R1 of first drug packaging paper PP1 is along conveyance direction D1.

The pair of rollers 32*b* guide first drug packaging paper PP1 without nipping the drug packaging paper. The pair of rollers 32*b* are disposed on the upstream side of first drug packaging paper PP1 from upstream guide member 32*a*. The pair of rollers 32*b* each have a cylindrical shape. The pair of rollers 32*b* include driving roller 32*b*1 and driven roller 32*b*2.

Driving roller 32*b*1 is configured to be rotated by a drive device (not illustrated) such as a motor. Driving roller 32*b*1 is disposed in such a way that the rotational axis thereof is parallel to the plate surface of upstream guide member 32*a* and orthogonal to conveyance direction D1 of first drug packaging paper PP1.

In addition, driving roller 32*b*1 is configured to move toward driven roller 32*b*2 to be located at conveying position Pm1, or to move away from driven roller 32*b*2 to be located at non-conveying position Pm2. When driving roller 32*b*1 is located at conveying position Pm1, the pair of rollers 32*b* can hold first drug packaging paper PP1 or second drug packaging paper PP2 located between the rollers and convey the drug packaging paper toward the downstream side.

Driven roller 32*b*2 is disposed with the rotational axis thereof inclined. That is, driven roller 32*b*2 is disposed in such a way that one end part of driven roller 32*b*2 (on the opened side of first drug packaging paper PP1) is located on the downstream side of first drug packaging paper PP1 from the other end part of driven roller 32*b*2 (on the ridge line R1 side of first drug packaging paper PP1). In addition, driven roller 32*b*2 contacts the side surface of first drug packaging paper PP1, thereby having a function of changing conveyance direction D1 (see FIG. 3).

The other upstream guide member 32*c* is a plate-shaped member sandwiched by second drug packaging paper PP2 fed out from second packaging paper holding part 31*b*. When first drug packaging paper PP1 is being conveyed, the downstream end part of second drug packaging paper PP2 is disposed at the other upstream guide member 32*c*.

The other upstream guide member 32*c* is disposed in such a way that the plate surface thereof is parallel to the plate surface of upstream guide member 32*a*, and the side surface thereof coinciding with ridge line R2 of second drug packaging paper PP2 is located on the same plane as the side surface of upstream guide member 32*a* coinciding with ridge line R1. The plate thickness of the other upstream guide member 32*c* is approximately the same as the plate thickness of upstream guide member 32*a*. As will be described below, at the time of replacing first drug packaging paper PP1 with second drug packaging paper PP2, the other upstream guide member 32*c* guides second drug packaging paper PP2.

The other pair of rollers 32*d* are disposed on the upstream side of second drug packaging paper PP2 from the other upstream guide member 32*c*. The other pair of rollers 32*d* are stationary with the downstream end part of second drug packaging paper PP2 located between the rollers. As will be described below, at the time of replacing first drug packaging paper PP1 with second drug packaging paper PP2, the other pair of rollers 32*d* nip and convey second drug packaging paper PP2.

The other pair of rollers 32*d* each have a cylindrical shape. The other pair of rollers 32*d* include driving roller 32*d*1 and driven roller 32*d*2.

Driving roller 32*d*1 is configured to be rotated by a drive device (not illustrated) such as a motor. Driving roller 32*d*1 is disposed in such a way that the rotational axis thereof is parallel to the plate surface of the other upstream guide member 32*c* and orthogonal to conveyance direction D1 of first drug packaging paper PP1.

In addition, driving roller 32*d*1 is configured to move toward driven roller 32*d*2 to be located at conveying position Pm1, or to move away from driven roller 32*d*2 to be located at non-conveying position Pm2. When driving roller 32*d*1 is located at conveying position Pm1, the other pair of rollers 32*d* can hold first drug packaging paper PP1 or second drug packaging paper PP2 located between the rollers and convey the drug packaging paper toward the downstream side.

Driven roller 32*d*2 is disposed with the rotational axis thereof inclined. That is, driven roller 32*d*2 is disposed in such a way that one end part of driven roller 32*d*2 (on the opened side of second drug packaging paper PP2) is located on the downstream side of second drug packaging paper PP2 from the other end part of driven roller 32*d*2 (on the ridge line R2 side of second drug packaging paper PP2). In addition, driven roller 32*d*2 contacts the side surface of second drug packaging paper PP2, thereby having a function of changing the conveyance direction of second drug packaging paper PP2.

Moving member 32*e* is configured to be able to move upstream guide member 32*a*, the pair of rollers 32*b*, the other upstream guide member 32*c*, and the other pair of rollers 32*d*, at the time of replacing first drug packaging paper PP1 with second drug packaging paper PP2, as described below. Upstream guide member 32*a*, the pair of rollers 32*b*, the other upstream guide member 32*c*, and the other pair of rollers 32*d* are disposed in moving member 32*e*. Moving member 32*e* slides between first guide position Pd1 illustrated in FIG. 4 and second guide position Pd2 illustrated in FIG. 8, which will be referred to.

First guide position Pd1 is a position of moving member 32*e* during the conveyance of first drug packaging paper PP1. When moving member 32*e* is at first guide position Pd1, the pair of rollers 32*b* guide first drug packaging paper PP1 without nipping first drug packaging paper PP1, and upstream guide member 32*a* guides first drug packaging paper PP1. Second guide position Pd2 is a position of moving member 32*e* when the other pair of rollers 32*d* nip and convey second drug packaging paper PP2 and the other upstream guide member 32*c* guides second drug packaging paper PP2 at the time of replacing first drug packaging paper PP1 with second drug packaging paper PP2, as described below. The position of the other upstream guide member 32*c* when moving member 32*e* is located at second guide position Pd2 is the same as the position of upstream guide member 32*a* when moving member 32*e* is located at first guide position Pd1 (see FIGS. 4 and 8).

Returning to FIG. 3, the description will be continued. Downstream conveying unit 33 is configured to convey first drug packaging paper PP1 guided by upstream conveying unit 32 to printer 15 and sealing device 16. Downstream conveying unit 33 conveys first drug packaging paper PP1 in such a way that first drug packaging paper PP1 receives a drug at drug delivery position Pr.

Downstream conveying unit 33 includes a pair of downstream rollers 33*a* that nip and convey first drug packaging paper PP1, a plurality of rollers 33*b* that change conveyance direction D1 of first drug packaging paper PP1, and downstream guide member 33*c*.

Downstream guide member 33*c* is a plate-shaped member sandwiched by first drug packaging paper PP1, and configured to guide first drug packaging paper PP1 to drug delivery position Pr. Downstream guide member 33*c* is disposed in such a way that the plate surface thereof is orthogonal to the horizontal direction. First drug packaging paper PP1 hold, in its inside, downstream guide member 33*c* with the opened side of the drug packaging paper facing upward (herein, "in its inside" does not necessarily mean that a component is completely in the inside of another component). First drug packaging paper PP1 is opened upward by being guided by downstream guide member 33*c*, and receives a drug led out from hopper 13*b* at drug delivery position Pr.

Holding member 34 is disposed between upstream conveying unit 32 and downstream conveying unit 33. Holding member 34 does not hold first drug packaging paper PP1 when conveying part 30 is conveying first drug packaging paper PP1. Holding member 34 holds first drug packaging paper PP1 between the members thereof when first drug packaging paper PP1 is to be replaced with second drug packaging paper PP2, as described below. Holding member 34 is composed of a pair of plate members 34*a* and 34*b*. The pair of plate members 34*a* and 34*b* are disposed in such a way that the plate surfaces of the members are parallel to the plate surface of upstream guide member 32*a*. As illustrated in FIG. 4, first plate member 34*a* and second plate member 34*b* are configured to be located at holding position Ps1 where the members hold first drug packaging paper PP1 therebetween or at a non-holding position Ps2 where the members does not hold first drug packaging paper PP1 therebetween.

Cutting part 35 cuts first drug wrapping paper PP1 when first drug packaging paper PP1 is to be replaced with second drug packaging paper PP2, as described below. Cutting part 35 includes a blade for cutting first drug packaging paper PP1. At a location between holding member 34 and upstream conveying unit 32, cutting part 35 cuts first drug packaging paper PP1 on plane S orthogonal to conveyance direction D1.

Base part 36 is disposed on the opposite side of cutting part 35 with first drug packaging paper PP1 therebetween, and has a rectangular parallelepiped shape having a facing surface that faces the side surface of first drug packaging paper PP1.

Figure 6:
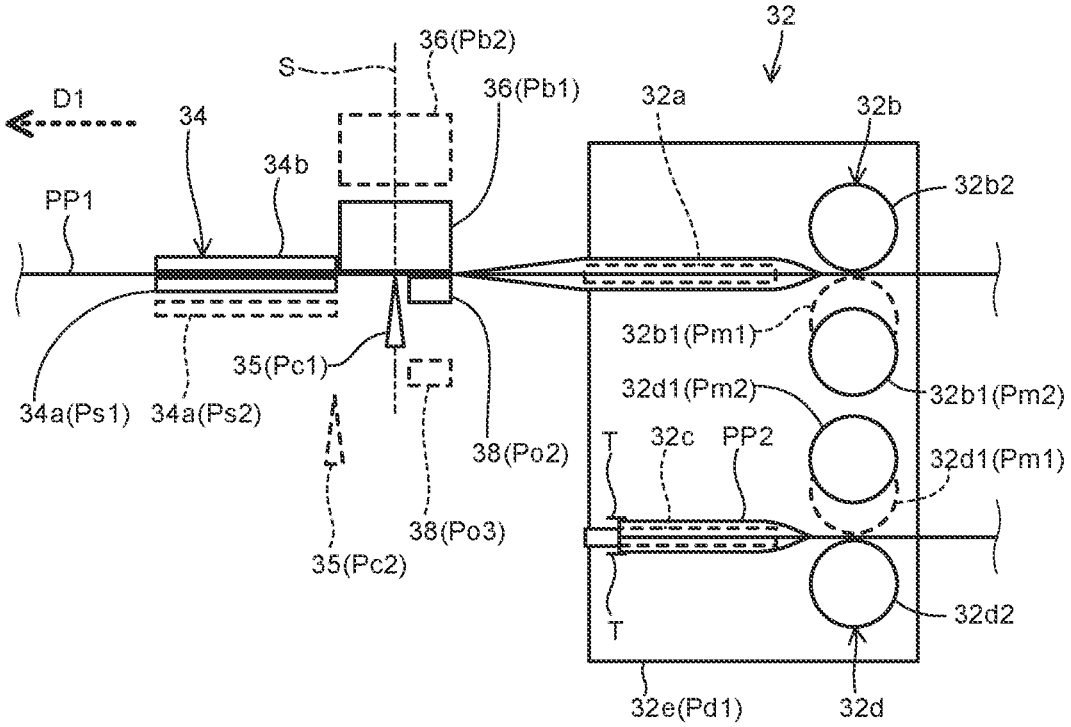
FIG. 6 schematically illustrates a state in which the first drug packaging paper is being cut.
Figure 7:
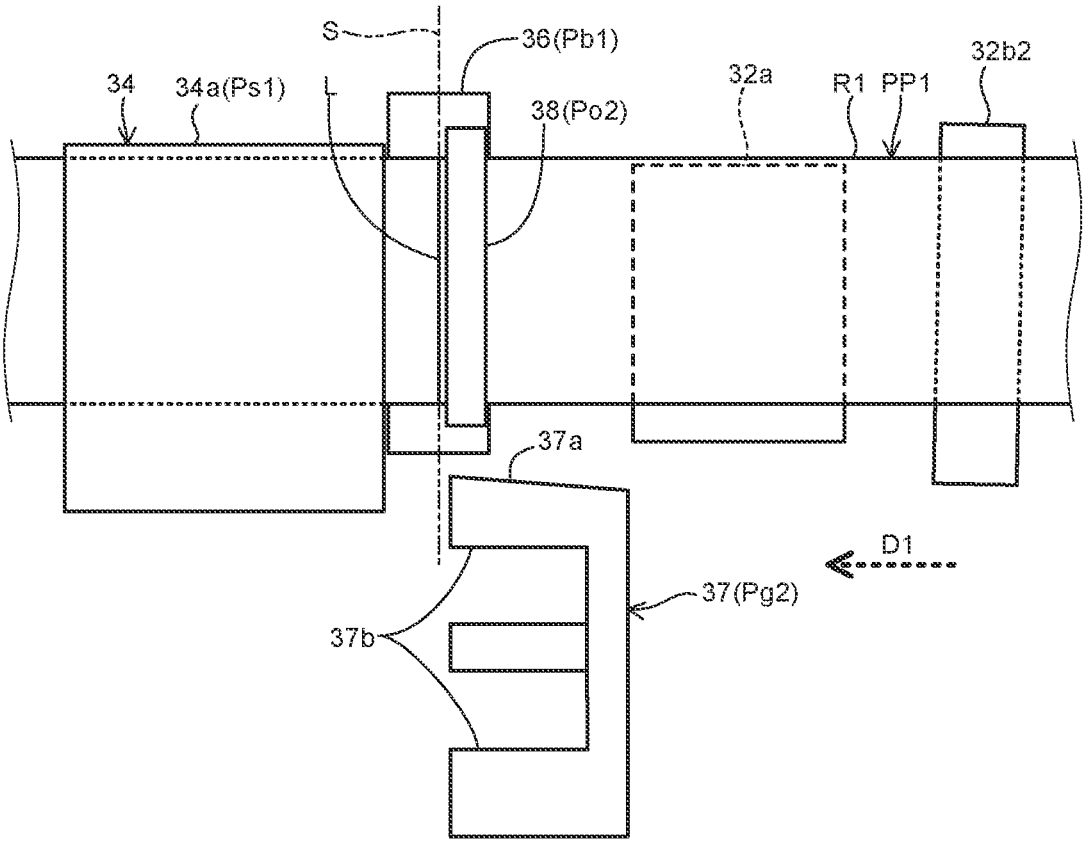
FIG. 7 illustrates the side and a periphery of the first drug packaging paper in FIG. 6.

As illustrated in FIG. 6, cutting part 35 is configured to be located at cutting position Pc1 where cutting part 35 cuts first drug packaging paper PP1 by moving toward first drug packaging paper PP1 or at a non-cutting position Pc2 that is away from first drug packaging paper PP1. In addition, base part 36 is configured to be located at contact position Pb1 where the facing surface of the base part is brought into contact with first drug packaging paper PP1 by moving toward first drug packaging paper PP1 or at non-contact position Pb2 where the facing surface is away from first drug packaging paper PP1. The facing surface of base part 36 comes into contact with the cutting edge of cutting part 35 at the time of cutting first drug packaging paper PP1 by cutting part 35. FIG. 7 is a side view illustrating first drug packaging paper PP1 and the periphery thereof at the time of cutting first drug packaging paper PP1.

Guide member 37 is disposed between holding member 34 and upstream conveying unit 32, as illustrated in FIGS. 3 to 5, and configured to guide second drug packaging paper PP2 when first drug packaging paper PP1 is to be replaced with second drug packaging paper PP2, as described below. Specifically, guide member 37 is disposed between plane S and upstream guide member 32*a*. Guide member 37 is a plate-shaped member. The plate thickness of guide member 37 is substantially the same as the plate thicknesses of upstream guide member 32*a* and the other upstream guide member 32*c*.

Figure 8:
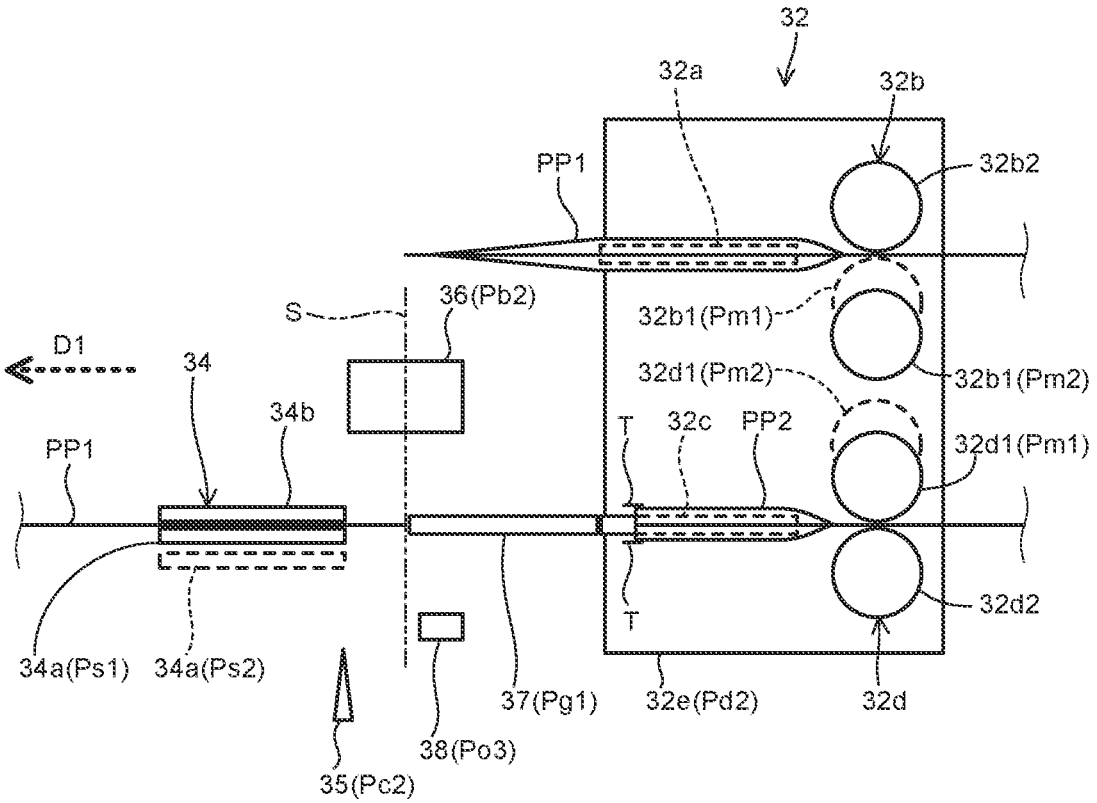
FIG. 8 schematically illustrates a state in which the moving member has moved.
Figure 9:
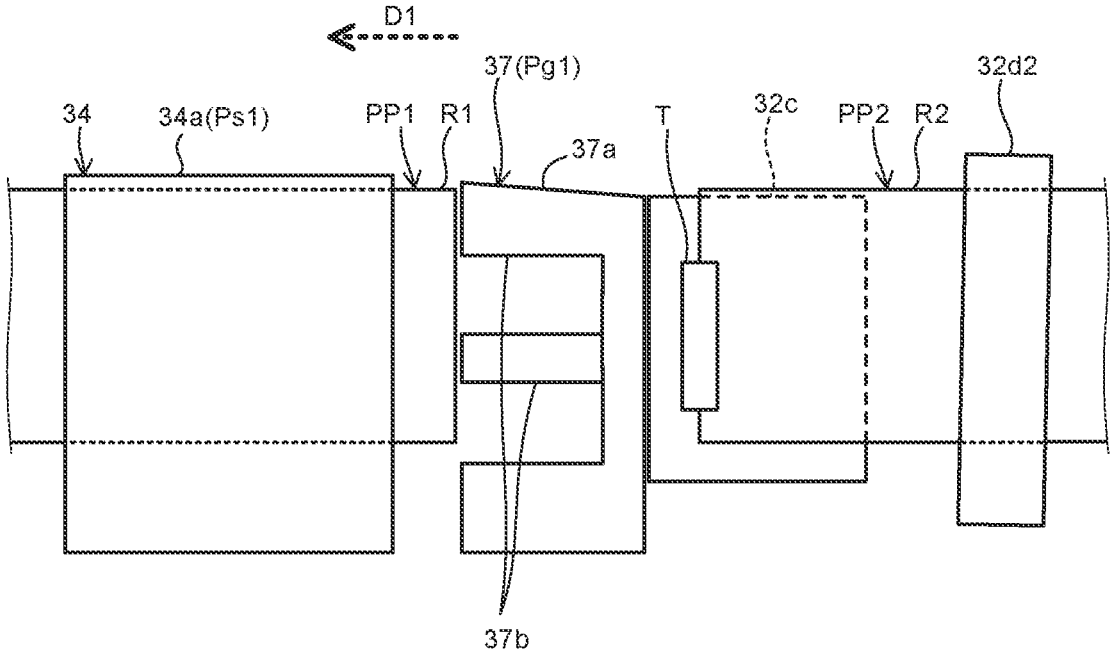
FIG. 9 illustrates the sides and a peripheries of the first drug packaging paper and the second drug packaging paper in FIG. 8.

During the conveyance of first drug packaging paper PP1 by upstream conveying unit 32 and downstream conveying unit 33, guide member 37 is located at non-guide position Pg2—a position where the guide member does not contact first drug packaging paper PP1, as illustrated in FIG. 5. As illustrated in FIGS. 8 and 9 indicating the state in which moving member 32*e* has moved, at the time of replacing first drug packaging paper PP1 with second drug packaging paper PP2, guide member 37 is located at guide position Pg1—a position where the guide member can guide second drug packaging paper PP2. That is, guide member 37 is configured to be movable between guide position Pg1 and non-guide position Pg2. Guide member 37 includes inclined part 37*a* and recessed part 37*b*.

Inclined part 37*a* is a side portion of guide member 37, and ridge line R2 of second drug packaging paper PP2 overlaps the side portion at the time of guiding second drug packaging paper PP2 by guide member 37. Inclined part 37*a* extends in a direction substantially parallel to ridge line R2 of second drug packaging paper PP2 guided by guide member 37. Specifically, inclined part 37*a* has a shape such that the inclined part is inclined from the opened side toward the ridge line R2 side of second drug packaging paper PP2 as the inclined part approaches the downstream side from the upstream side of second drug packaging paper PP2. Inclined part 37*a* has a flat shape. Inclined part 37*a* may have a triangular cross section or an arcuate cross section.

Recessed part 37*b* is a portion recessed approximately along conveyance direction D1 from the side portion (downstream in conveyance direction D1) of guide member 37.

Connecting part 38 is disposed on the same side as cutting part 35 when viewed from first drug packaging paper PP1, and has a rectangular parallelepiped shape having a facing surface that faces the side surface of first drug packaging paper PP1. Connecting part 38 connects the downstream end part of second drug packaging paper PP2 to first drug packaging paper PP1 when first drug packaging paper PP1 is to be replaced with second drug packaging paper PP2, as described below. Connecting part 38 includes pressing part 38*a* configured to press connecting member T. Connecting member T is configured to connect first drug packaging paper PP1 with second drug packaging paper PP2. Pressing part 38*a* is a facing surface that faces the side surface of first drug packaging paper PP1.

Connecting member T is, for example, an adhesive tape. In a state where second drug packaging paper PP2 is disposed at the other upstream guide member 32*c*, connecting member T is attached to the downstream end part of second drug packaging paper PP2 so as to protrude from the downstream end of the drug packaging paper. Connecting members T are attached to both outer surfaces of second drug packaging paper PP2, which is folded in half Connecting member T may be an adhesive applied to the inside of the downstream end part of second drug packaging paper PP2.

Connecting part 38 is configured to be located at first pressing position Po1 (see FIG. 12), second pressing position Po2 (see FIG. 6), or a non-pressing position Po3 (see FIG. 4).

First pressing position Po1 (see FIG. 12) of connecting part 38 is a position where pressing part 38*a* and base part 36 located at contact position Pb1 hold first drug packaging paper PP1, second drug wrapping paper PP2, and connecting member T therebetween and press them at the time of connecting first drug packaging paper PP1 with second drug packaging paper PP2, as described below.

Second pressing position Po2 (see FIG. 6) of connecting part 38 is a position where pressing part 38*a* and base part 36 located at contact position Pb1 hold first drug packaging paper PP1 therebetween and press first drug packaging paper PP1 at the time of cutting first drug packaging paper PP1 by cutting part 35, as described below. Second pressing position Po2 is on the upstream side of first drug packaging paper PP1 from plane S.

Non-pressing position Po3 of connecting part 38 is a position where connecting part 38 is separated from first drug packaging paper PP1 and thus does not press first drug packaging paper PP1.

In the following, the operation of drug supply apparatus 1 when first drug packaging paper PP1 is to be replaced with second drug packaging paper PP2 will be described.

As illustrated FIGS. 3 to 5, when conveying part 30 is conveying first drug packaging paper PP1, driving roller 32*b*1 is located at the non-conveying position Pm2, first plate member 34*a* of holding member 34 is located at the non-holding position Ps2, and cutting part 35 is located at non-cutting position Pc2. In addition, base part 36 is located at non-contact position Pb2, connecting part 38 is located at non-pressing position Po3, and guide member 37 is located at non-guide position Pg2. In addition, upstream guide member 32*a* guides first drug packaging paper PP1 while being sandwiched by first drug packaging paper PP1.

When the control part detects that first drug packaging paper PP1 is running low, the control part stops the operation of drug supply unit 13 and also stops the operation of the pair of downstream rollers 33*a*. The control part detects that first drug packaging paper PP1 is running low, for example, based on a detection signal from a sensor (for example, an infrared sensor) detecting the outer diameter of roll M1 or from a sensor detecting the tension of first drug packaging paper PP1. The sensor detecting the tension of first drug packaging paper PP1 is, for example, a load sensor that detects the force acting on roller 33*b* of downstream conveying unit 33. The tension of first drug packaging paper PP1 increases as the amount of first drug packaging paper PP1 decreases.

In addition, the following configuration is also possible: when the tension of first drug packaging paper PP1 increases, roller 33*b* moves, and the control part detects that first drug packaging paper PP1 is running low based on a detection signal from a position sensor detecting the position of roller 33*b*.

Subsequently, as illustrated in FIG. 6, the control part moves first plate member 34*a* to holding position Ps1. As a result, holding member 34 holds first drug packaging paper PP1 between the members thereof. Further, the control part moves base part 36 to contact position Pb1 and moves connecting part 38 to second pressing position Po2. As a result, base part 36 and connecting part 38 hold first drug packaging paper PP1 therebetween at a location between holding member 34 and upstream conveying unit 32.

The control part then cuts first drug packaging paper PP1 at cutting position Pc1 by moving cutting part 35 in a direction orthogonal to conveyance direction D1. Solid line L along plane S illustrated in FIG. 7 represents the ends of first drug packaging paper PP1 formed when first drug packaging paper PP1 is cut (the ends being the upstream end on the side held by holding member 34 and the downstream end on the side held by base part 36 and connecting part 38). On the upstream side from plane S, first drug packaging paper PP1 is held by base part 36 and connecting part 38. On the downstream side from plane S, first drug packaging paper PP1 is held by holding member 34. Therefore, cutting part 35 can reliably cut first drug packaging paper PP1 in a straight line without shifting the position of first drug packaging paper PP1.

When cutting part 35 finishes the cutting, the control part positions cutting part 35 at non-cutting position Pc2, moves connecting part 38 to non-pressing position Po3, and moves base part 36 to non-contact position Pb2.

Subsequently, the control part moves driving roller 32*d*1 of the other pair of rollers 32*d* so that the other pair of rollers 32*d* hold the downstream end part of second drug packaging paper PP2 therebetween. In this state, the control part moves moving member 32*e* from first guide position Pd1 to second guide position Pd2, as illustrated in FIGS. 8 and 9. The other upstream guide member 32*c* is thus located at the position where upstream guide member 32*a* has been located before moving member 32*e* moves. In addition, the downstream end part of second drug packaging paper PP2 faces the upstream end part of first drug packaging paper PP1.

The control part further moves guide member 37 to guide position Pg1. As a result, guide member 37 and upstream guide member 32*a* face each other. Subsequently, the control part rotates driving roller 32*d*1 to convey second drug packaging paper PP2.

As illustrated in FIG. 9, driven roller 32*d*2 is disposed at an angle. Specifically, driven roller 32*d*2 is disposed in such a way that one end part of driven roller 32*d*2 (on the opened side of second drug packaging paper PP2) is located on the downstream side of second drug packaging paper PP2 from the other end part of driven roller 32*d*2 (on the ridge line R2 side of second drug packaging paper PP2). Therefore, the other pair of rollers 32*d* convey second drug packaging paper PP2 in a direction inclined with respect to conveyance direction D1 of first drug packaging paper PP1.

Specifically, the other pair of rollers 32*d* convey second drug packaging paper PP2 in such a way that the opened side of the downstream end part of second drug packaging paper PP2 approaches the ridge line R1 side of the upstream end part of first drug packaging paper PP1. When second drug packaging paper PP2 is conveyed to guide member 37, second drug packaging paper PP2 is guided by guide member 37. Describing with reference to the state illustrated in FIG. 9, guide member 37 guides second drug packaging paper PP2 in such a way that as second drug packaging paper PP2 moves leftward, the left end of second drug packaging paper PP2 moves upward.

That is, second drug packaging paper PP2 is guided by inclined part 37*a* of guide member 37 in such a way that as the downstream end part of second drug packaging paper PP2 approaches the upstream end part of first drug packaging paper PP1, the opened side of the downstream end part of second drug packaging paper PP2 approaches the ridge line R1 side of the upstream end part of first drug packaging paper PP1. In other words, the direction in which inclined part 37*a* guides second drug packaging paper PP2 is approximately the same as the direction in which the other pair of rollers 32*d* convey second drug packaging paper PP2. Therefore, second drug packaging paper PP2 is smoothly conveyed and guided without being caught by inclined part 37*a*. In addition, guide member 37 includes recessed part 37*b*, thereby reducing contact of connecting member T with guide member 37.

Figure 10:
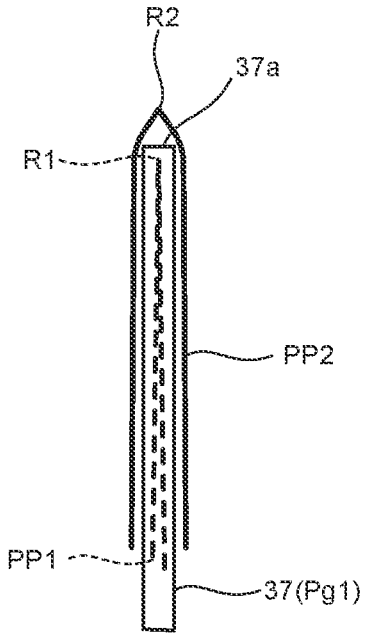
FIG. 10 is a longitudinal cross-sectional view of a guide member and a periphery thereof, FIG. 11 schematically illustrates a state in which the second drug packaging paper has been conveyed.
Figure 11:
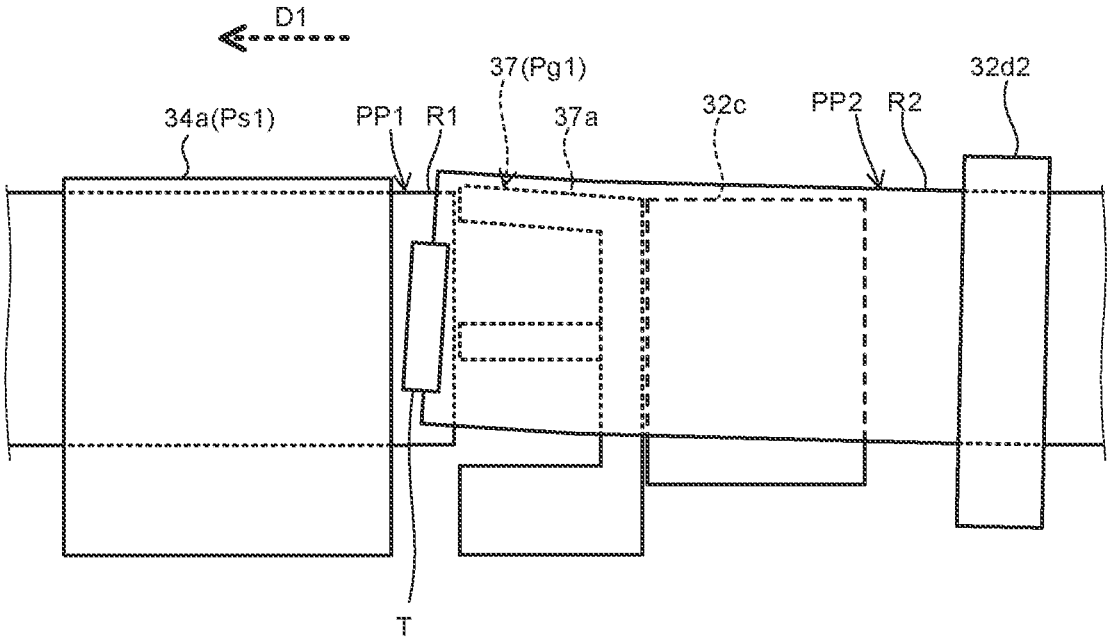

As second drug packaging paper PP2 is conveyed and guided as described above, when second drug packaging paper PP2 is conveyed to the downstream end part of first drug packaging paper PP1, ridge line R2 of second drug packaging paper PP2 is located above ridge line R1 of first drug packaging paper PP1. As illustrated in FIG. 10, a longitudinal cross-sectional view of guide member 37 and a periphery thereof, second drug packaging paper PP2 is wider than the plate thickness of guide member 37. The downstream end part of second drug packaging paper PP2 thus holds in its inside the upstream end part of first drug packaging paper PP1, and ridge line R2 of second drug packaging paper PP2 overlaps ridge line R1 of first drug packaging paper PP1, as illustrated in FIG. 11. Second drug packaging paper PP2 is thus smoothly conveyed and guided without the downstream end part of second drug packaging paper PP2 bumping into the upstream end part of first drug packaging paper PP1.

At this time, first drug packaging paper PP1 is held by holding member 34 between the members thereof. Therefore, even when the moving second drug packaging paper PP2 or the moving connecting member T comes into contact with first drug packaging paper PP1, first drug packaging paper PP1 can stay at a predetermined position without shifting to the downstream side.

That is, upstream conveying unit 32 conveys second drug packaging paper PP2 in such a way that the opened side of the downstream end part of second drug packaging paper PP2 approaches the ridge line R1 side of the upstream end part of first drug packaging paper PP1. In addition, upstream conveying unit 32 conveys second drug packaging paper PP2 toward first drug packaging paper PP1 in such a way that the downstream end part of second drug packaging paper PP2 holds in its inside the upstream end part of first drug packaging paper PP1, and ridge line R2 of second drug packaging paper PP2 overlaps ridge line R1 of first drug packaging paper PP1. Therefore, in the case of replacing packaging paper, second drug packaging paper PP2 is smoothly conveyed to overlap first drug packaging paper PP1 while preventing the generation of folds in first drug packaging paper PP1 and second drug packaging paper PP2.

The control part stops the operation of the pair of rollers 32*b* in response to the downstream end part of second drug packaging paper PP2 overlapping the upstream end part of first drug packaging paper PP1. The control part detects that the downstream end part of second drug packaging paper PP2 overlaps the upstream end part of first drug packaging paper PP1 based on a detection signal from a position sensor (for example, an infrared sensor) detecting the position of second drug packaging paper PP2.

Figure 12:
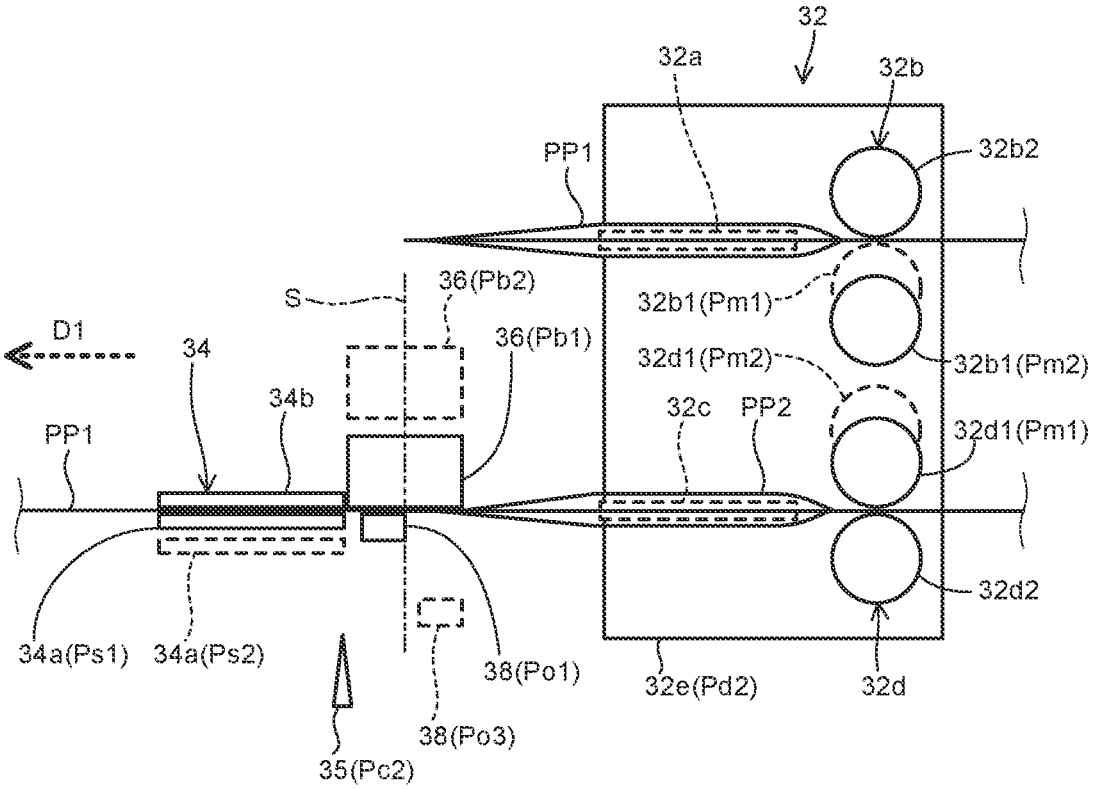
FIG. 12 schematically illustrates a state in which the first drug packaging paper and the second drug packaging paper are being connected to each other.

Subsequently, the control part positions guide member 37 at non-guide position Pg2. Furthermore, the control part positions base part 36 at contact position Pb1 and connecting part 38 at first pressing position Po1, as illustrated in FIG. 12. As a result, connecting member T is located between base part 36 and connecting part 38 and pressed, thereby connecting first drug packaging paper PP1 with second drug packaging paper PP2.

Figure 13:
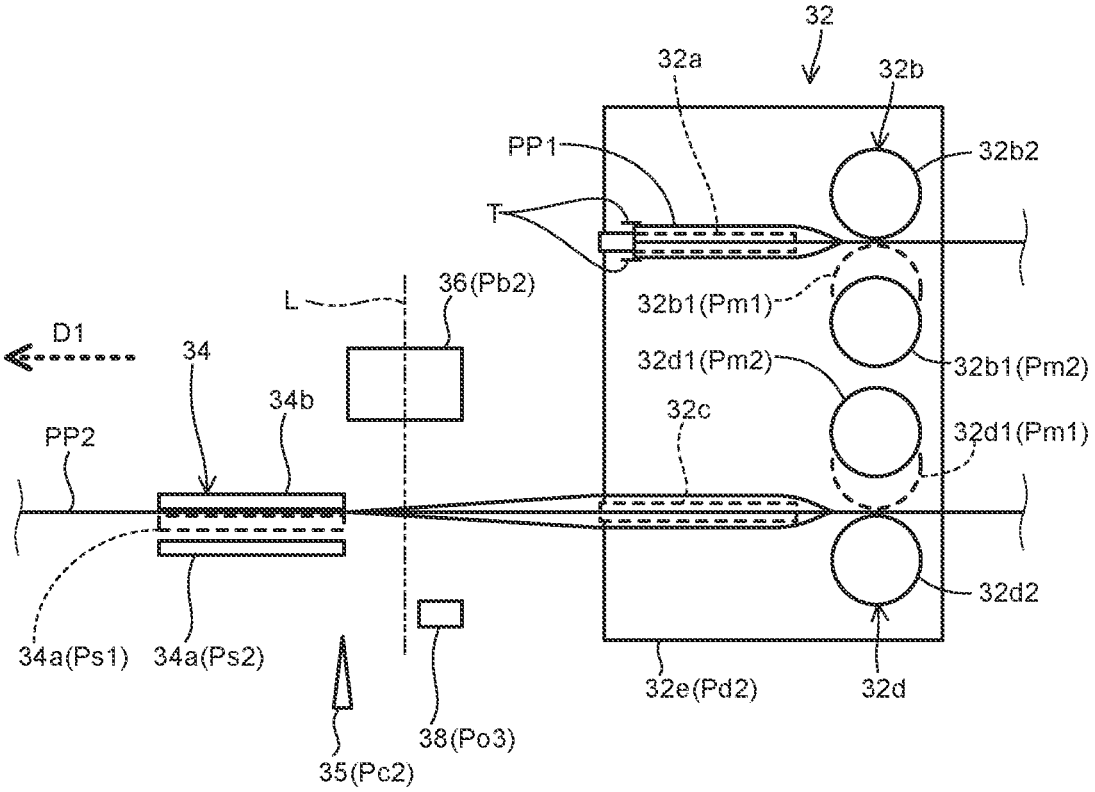
FIG. 13 schematically illustrates a state in which the second drug packaging paper is being conveyed.

The control part then positions connecting part 38 at non-pressing position Po3, base part 36 at non-contact position Pb2, first plate member 34*a* at non-holding position Ps2, and driving roller 32*d*1 at non-conveying position Pm2, as illustrated in FIG. 13.

Further, when first drug packaging paper PP1 is conveyed by the pair of downstream rollers 33*a* due to the operation by the control part, second drug packaging paper PP2 connected to first drug packaging paper PP1 is also conveyed. When first drug packaging paper PP1 is consumed, the packaging paper conveyed by conveying part 30 is switched to second drug packaging paper PP2. In addition, the downstream end part of second drug packaging paper PP2 holds, in its inside, the upstream end part of first drug packaging paper PP1; therefore, the upstream end of second drug packaging paper PP2 is not caught by downstream guide member 33*c*. Therefore, switching to second drug packaging paper PP2 is performed smoothly.

As described above, drug supply apparatus 1 automatically replaces first drug packaging paper PP1 with second drug packaging paper PP2. Therefore, it is possible to improve the efficiency and shorten the time required to replace packaging paper. In addition, roll M2 is held by second packaging paper holding part 31*b*, and the downstream end part of second drug packaging paper PP2 is disposed at the other upstream guide member 32*c*. Such a configuration allows the control part to convey second drug packaging paper PP2 to connect second drug packaging paper PP2 to first drug packaging paper PP1 in response to first drug packaging paper PP1 being running low, without waiting for the supply of roll M2 of second drug packaging paper PP2.

Even after first drug packaging paper PP1 is replaced with second drug packaging paper PP2, first drug packaging paper PP1 is placed at upstream conveying unit 32 and is held in first packaging paper holding part 31*a*, as illustrated in FIG. 12. Before second drug packaging paper PP2 runs low, an operator replaces first drug packaging paper PP1 (placed at upstream conveying unit 32 and in first packaging paper holding part 31*a*) with a new roll M1 of first drug packaging paper PP1.

Drug supply apparatus 1 may notify an operator that the packaging paper has been replaced by, for example, displaying a message on a display or sounding a buzzer. In response to the notification, the operator replaces roll M1 with a new roll.

Specifically, the operator removes first drug packaging paper PP1 from first packaging paper holding part 31*a* and attaches a new roll M1. The operator then disposes the downstream end part (fed out from the new roll M1) of first drug packaging paper PP1 at upstream guide member 32*a*, as illustrated in FIG. 13. Subsequently, the operator attaches connecting member T to the downstream end part of first drug packaging paper PP1 so as to protrude from the downstream end of the drug packaging paper.

When the control part detects that second drug packaging paper PP2 is running low, for example, based on the detection signal of the position sensor described above, the control part automatically replaces second drug packaging paper PP2 with the new first drug packaging paper PP1 in the same manner as when the old first drug packaging paper PP1 is automatically replaced with second drug packaging paper PP2 as described above. When the control part replaces second drug packaging paper PP2 with a new first drug packaging paper PP1, conveying part 30 conveys the new first drug packaging paper PP1 as in the state illustrated in FIG. 3.

The present disclosure is not limited to the embodiment described above. Various variations derived from the present embodiment are also included within the scope of the present disclosure, as long as those variations do not depart from the spirit of the present disclosure.

For example, first drug packaging paper PP1 and second drug packaging paper PP2 may be connected to each other by heat sealing. In this case, connecting part 38 is configured to include a heater. It is not necessary to attach connecting member T to second drug packaging paper PP2.

First drug packaging paper PP1 and second drug packaging paper PP2 may be connected to each other without being overlapping. The downstream end part of second drug packaging paper PP2 may be connected to a portion other than the upstream end part of first drug packaging paper PP1.

In the pairs of rollers 32*b* and rollers 32*d*, not only driven rollers 32*b*2 and 32*d*2 but also driving rollers 32*b*1 and 32*d*1 may be disposed to be inclined in the same manner as driven rollers 32*b*2 and 32*d*2. In place of disposing driven rollers 32*b*2 and 32*d*2 so as to be inclined, driving rollers 32*b*1 and 32*d*1 may be disposed to be inclined.

When first drug packaging paper PP1 is to be replaced with second drug packaging paper PP2, second drug packaging paper PP2 may be conveyed along conveyance direction D1. In this case, driven rollers 32*b*2 and 32*d*2 may be disposed so that the rotational axes of the rollers are orthogonal to conveyance direction D1, that is, not inclined.

Figure 14:
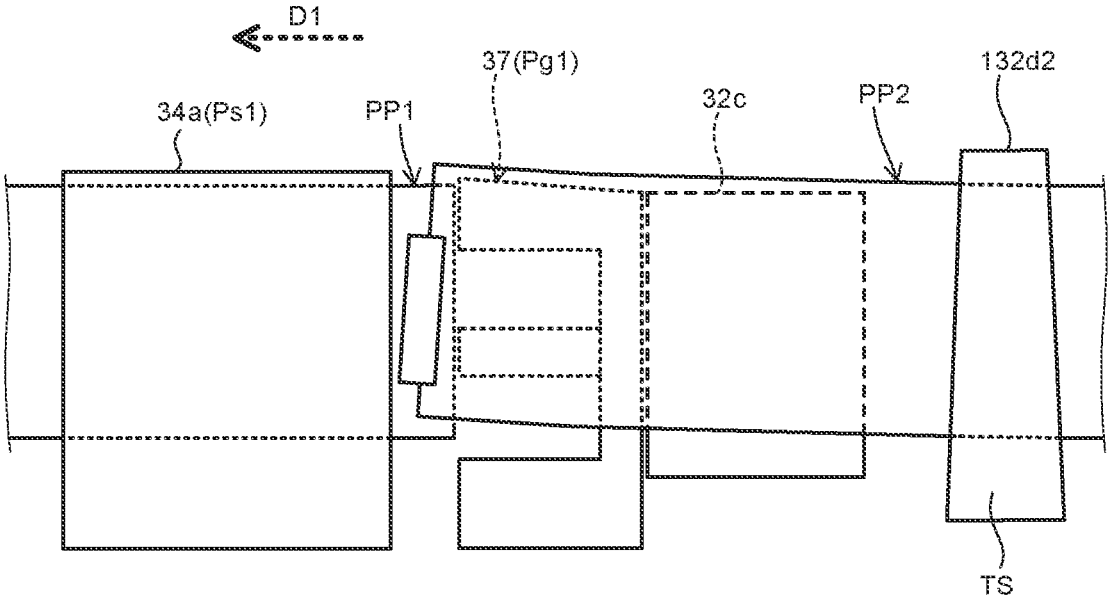
FIG. 14 illustrates a variation of a pair of rollers.

As illustrated in FIG. 14, the following configuration is also possible: the circumferential side surface of driven roller 132*d*2 is tapered surface TS in which the circumferential length on the opened side of second drug packaging paper PP2 is longer than the circumferential length on the ridge line R2 side of second drug packaging paper PP2. Driven roller 132*d*2 is disposed in such a way that the rotational axis thereof is orthogonal to conveyance direction D1 of first drug packaging paper PP1, and tapered surface TS is in line contact with the side surface of second drug packaging paper PP2. Due to this tapered surface TS, second drug packaging paper PP2 is conveyed in such a way that the opened side of the downstream end part of second drug packaging paper PP2 approaches the ridge line R1 side of the upstream end part of first drug packaging paper PP1. At least one of the circumferential side surfaces of driven roller 32*b*2 and driving rollers 32*b*1 and 32*d*1 may be tapered surface TS.

In addition, conveying part 30 does not need to include second packaging paper holding part 31*b*, the other upstream guide member 32*c*, the other pair of rollers 32*d*, and moving member 32*e*. In this case, at the time of replacing first drug packaging paper PP1 with second drug packaging paper PP2, the control part positions cutting part 35 at non-cutting position Pc2 after cutting first drug packaging paper PP1, moves connecting part 38 to non-pressing position Po3, and moves base part 36 to non-contact position Pb2. In this state, the control part stops the operation of conveying part 30. At this time, the control part may notify an operator of the request for replacement of the roll by, for example, displaying a message on a display.

The operator then removes first drug packaging paper PP1 from first packaging paper holding part 31*a* and attaches roll M2 of second drug packaging paper PP2 to first packaging paper holding part 31*a*. The operator further disposes the downstream end part of second drug packaging paper PP2 at upstream guide member 32*a*, and attaches connecting member T to the downstream end part of second drug packaging paper PP2.

Subsequently, the operator inputs information, indicating that the attachment of the roll has been completed, on operation part 11. In response, the control part moves guide member 37 to guide position Pg1 and positions driving roller 32*b*1 at conveying position Pm1. The control part further rotates driving roller 32*b*1 to convey second drug packaging paper PP2. As a result, second drug packaging paper PP2 is conveyed and guided as described above and connected to first drug packaging paper PP1 by connecting part 38. Downstream conveying unit 33 conveys first drug packaging paper PP1 as described above, and thus first drug packaging paper PP1 is replaced with second drug packaging paper PP2.

In addition, drug supply apparatus 1 does not need to include cutting part 35. In this case, the operator manually cuts first drug packaging paper PP1, and while the operator performs the cutting work, the control part stops the operation of conveying part 30 configured to replace packaging paper.

In addition, drug supply apparatus 1 does not need to include connecting part 38. In this case, the operator manually connects first drug packaging paper PP1 with second drug packaging paper PP2, and while the operator performs the connecting work, the control part stops the operation of conveying part 30 configured to replace packaging paper.

This application is entitled to and claims the benefit of Japanese Patent Application No. 2021-159486 filed on Sep. 29, 2021, the disclosure of which including the specification, drawings, and abstract is incorporated herein by reference in its entirety.

INDUSTRIAL APPLICABILITY

The present disclosure is widely available for drug supply apparatuses.

REFERENCE SIGNS LIST

1 Drug supply apparatus
13 Drug supply unit
30 Conveying part
31 Packaging paper holding part
32 Upstream conveying unit
32*e* Moving member
33 Downstream conveying unit
35 Cutting part
37 Guide member
38 Connecting part
38*a* Pressing part
M1 Roll
M2 Roll
PP1 First drug packaging paper
PP2 Second drug packaging paper
Pr Drug delivery position
R1 Ridge line of first drug packaging paper
R2 Ridge line of second drug packaging paper
T Connecting member
TS Tapered surface

The invention claimed is:

1. A drug supply apparatus, comprising:

a drug supply unit configured to supply a drug to a drug delivery position;

a downstream conveying unit configured to convey a first drug packaging paper in such a way that the first drug packaging paper receives the drug at the drug delivery position, wherein the first drug packaging paper is strip shaped and folded in half in advance along a longitudinal direction of the first drug packaging paper;

an upstream conveying unit configured to convey a second drug packaging paper toward the first drug packaging paper, wherein the second drug packaging paper is strip shaped and folded in half in advance along a longitudinal direction of the second drug packaging paper; and a connecting part configured to connect a downstream end part of the second drug packaging paper to the first drug packaging paper, wherein:

the downstream conveying unit includes a pair of downstream rollers, the upstream conveying unit includes a first upstream guide member, a second upstream guide member, a first pair of rollers, a second pair of rollers, and a moving member, the first upstream guide member, the second upstream guide member, the first pair of rollers, and the second pair of rollers are disposed in the moving member, and the first upstream guide member has a plate shape, and the first upstream guide member is configured to guide the first drug packaging paper with the first upstream guide member being sandwiched by the first drug packaging paper.

2. The drug supply apparatus according to claim 1, further comprising:

a packaging paper holding part configured to hold a package of the second drug packaging paper.

3. The drug supply apparatus according to claim 2, wherein the packaging paper holding part is configured to further hold a package of the first drug packaging paper.

4. The drug supply apparatus according to claim 1, wherein the connecting part includes a pressing part configured to press a connecting member that is configured to connect the first drug packaging paper with the second drug packaging paper.

5. The drug supply apparatus according to claim 1, further comprising:

a cutting part configured to cut the first drug packaging paper, wherein the connecting part connects the downstream end part of the second drug packaging paper to an upstream end part of the first drug packaging paper, the upstream end part being formed when the cutting part cuts the first drug packaging paper.

6. The drug supply apparatus according to claim 5, wherein the upstream conveying unit conveys the second drug packaging paper in such a way that the downstream end part of the second drug packaging paper holds, in an inside of the downstream end part, the upstream end part of the first drug packaging paper, and a ridge line of the second drug packaging paper overlaps a ridge line of the first drug packaging paper.

7. The drug supply apparatus according to claim 5, wherein the moving member is configured to move the second drug packaging paper in such a way that the downstream end part of the second drug packaging paper faces the upstream end part of the first drug packaging paper.

8. The drug supply apparatus according to claim 1, wherein the second upstream guide member has a plate shape, and the second upstream guide member is configured to guide the second drug packaging paper with the second upstream guide member being sandwiched by the second drug packaging paper.

9. The drug supply apparatus according to claim 1, further comprising:

a pair of holding members disposed between the upstream conveying unit and the downstream conveying unit, and each of the pair of holding members has a plate shape.

10. The drug supply apparatus according to claim 1, wherein the moving member is configured to be located at a first guide position and a second guide position, when the moving member is located at the first guide position, the first pair of rollers guide the first drug packaging paper without nipping the first drug packaging paper, and the first upstream guide member guides the first drug packaging paper, when the moving member is located at the second guide position, the second pair of rollers nip and convey the second drug packaging paper, and the second upstream guide member guides the second drug packaging paper at the time of replacing the first drug packaging paper with the second drug packaging paper, and a position of the second upstream guide member when the moving member is located at the second guide position is the same as a position of the first upstream guide member when the moving member is located at the first guide position.

* * * * *